United States Patent [19]

Abernethy

[11] Patent Number: 5,015,200

[45] Date of Patent: May 14, 1991

[54] CONNECTOR WITH DOUBLE ACTING LATCH

[75] Inventor: Lynn W. Abernethy, Winston-Salem, N.C.

[73] Assignee: AMP Incorporated, Harrisburg, Pa.

[21] Appl. No.: 481,936

[22] Filed: Feb. 20, 1990

[51] Int. Cl.[5] ..... H01R 13/627

[52] U.S. Cl. ..... 439/357; 439/595

[58] Field of Search ..... 439/595, 350, 351, 352, 439/353, 354, 355, 356, 357, 660, 680

[56] References Cited

U.S. PATENT DOCUMENTS

| | | | |
|---|---|---|---|
| 4,299,433 | 11/1981 | Jayne | 439/350 |
| 4,603,929 | 8/1986 | Fitzpatrick | 439/680 |
| 4,801,275 | 1/1989 | Ikeda et al. | 439/357 |

FOREIGN PATENT DOCUMENTS

| | | |
|---|---|---|
| 0177359 | 3/1985 | European Pat. Off. . |
| 60-142463 | 9/1985 | Japan . |
| 60-32680 | 6/1988 | Japan . |
| 60-34051 | 10/1988 | Japan . |

OTHER PUBLICATIONS

U.S. patent application Ser. No. 07/280,735 field 12-6-88.

Adverstisement "EH", HR Connector.

*Primary Examiner*—David L. Pirlot

*Assistant Examiner*—Julie R. Daulton

*Attorney, Agent, or Firm*—Robert W. Pitts; Allan B. Osborne

[57] ABSTRACT

An electrical connector assembly comprising a receptacle connector and a pin header is disclosed. The receptacle connector is attached to wires and the pin header can be secured to a printed circuit board. The receptacle connector is secured in the shrouded pin header by a double acting connector latch extending upwardly from one wall of the header housing. Connector latch comprises a yoke section with upwardly extending deflectable arms and a centrally disposed downwardly extending deflectable cantilever beam. The latching protrusion engages a trough located on the exterior of the receptacle connector.

6 Claims, 3 Drawing Sheets

CONNECTOR WITH DOUBLE ACTING LATCH

BACKGROUND OF THE INVENTION

1. Field of the Invention

This invention relates to an electrical connector assembly including a connector and a mating printed circuit board header. More particularly, this application relates to an assembly in which the printed circuit board header is a shrouded header having a double acting latch for securing the connector in the header in a low profile configuration.

2. Description of the Prior Art

U.S. patent application Ser. No. 07/280,753 filed Dec. 6, 1988, discloses a miniature insulation displacement electrical contact used in a receptacle connector. The contact terminal described in that patent application is intended for establishing an insulation displacement innerconnection to an insulated conductor. That contact terminal includes at least one slotted plate which is secured to one or more sidewalls extending transversely passed the slotted plate. The slotted plates are secured to the sidewalls by embossments formed in the sidewalls on opposite sides of the plates Sheared edges of these embossments extend parallel to the opposite faces of the slotted plates and provide a secure engagement with a slotted plate. Each of these contact terminals includes a strain relief portion adjacent one end to engage a wire inserted into the slotted plate terminal. A pin contact receptacle is provided at the other end of each terminal A plurality of these contact terminals are positioned within an insulative housing in side-by-side configuration. These terminals are of the type suitable for positioning on very closely spaced centerlines. For example, one embodiment of this invention the terminals are spaced apart on centerlines equal to 2.5 mm. These receptacle connectors are attachable to pins extending upwardly from a pin header The connector has alignment ribs on opposite ends of the connector housing which are inserted within slots in upstanding sidewalls of a mating pin header. A similar receptacle connector is disclosed in Japanese Utility Model Application 60-142463. An example of a connector and header assembly of this type is also shown in Japanese Patent Document 60-32680.

SUMMARY OF THE INVENTION

An electrical connector assembly comprising a receptacle connector and a mating connector header is disclosed The receptacle connector has a plurality of terminals held in a housing by plastic contact latches. Each of the plastic contact latches has an inclined or sloping rear surface. A trough extends laterally of the plastic latches adjacent the free ends of the plastic latches. The connector header has a connector latch configured for receipt within the trough on the receptacle connector. The connector latch comprises a portion of an integrally molded shrouded header housing. The connector latch comprises a cantilever beam which extends downwardly from a yoke section formed along the top of one wall of the header housing. The yoke section has two arms which extend upwardly and are joined by a crosspiece at the top of the yoke section. The cantilever beam extends downwardly from this crosspiece, and the cantilever beam has a latching protrusion which is received within the trough on the receptacle connector. This connector latch comprises a double acting latch in which both the arms and the cantilever beam are deflectable to permit insertion of the receptacle connector into the header housing. A relatively low profile receptacle connector-pin header assembly is thus provided.

BRIEF DESCRIPTION OF THE DRAWINGS

FIG. 3 is a perspective view, partially in section of a mated receptacle connector and pin header.

DETAILED DESCRIPTION OF THE PREFERRED EMBODIMENT

Figure 1:
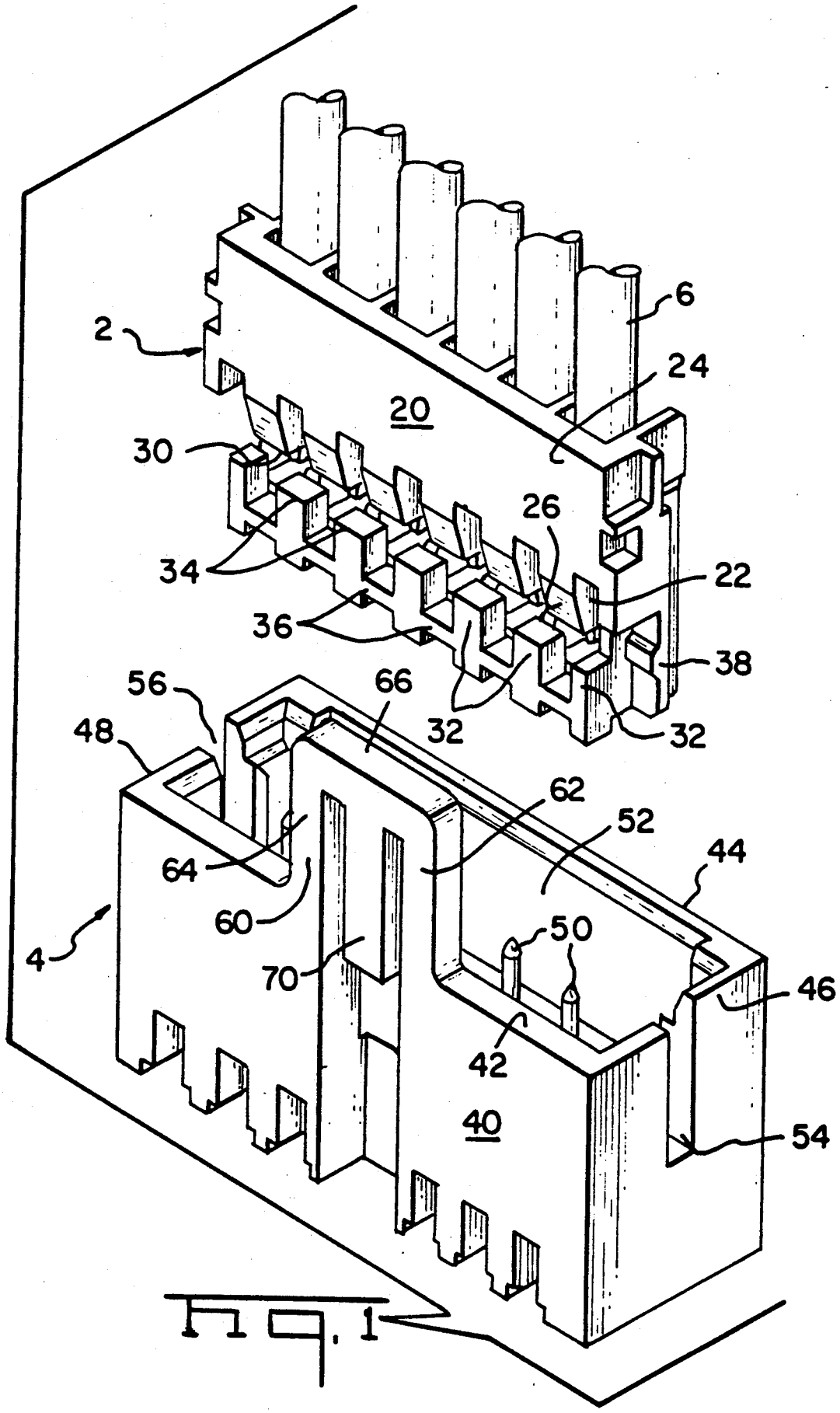
FIG. 1 is an exploded perspective view showing the receptacle connector positioned above the pin header.
Figure 2:
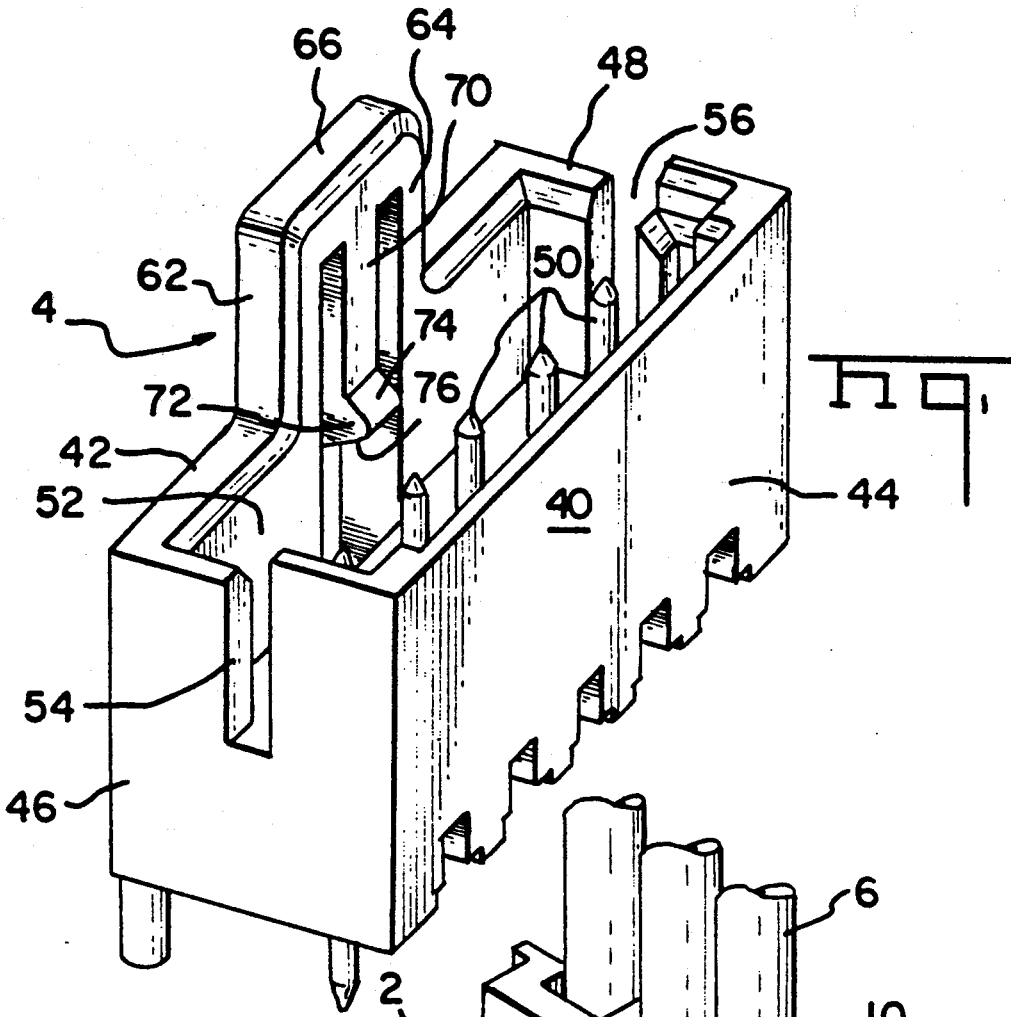
FIG. 2 is a perspective view showing the pin header and the double acting connector latch extending upwardly from one wall of the pin header.
Figure 1:
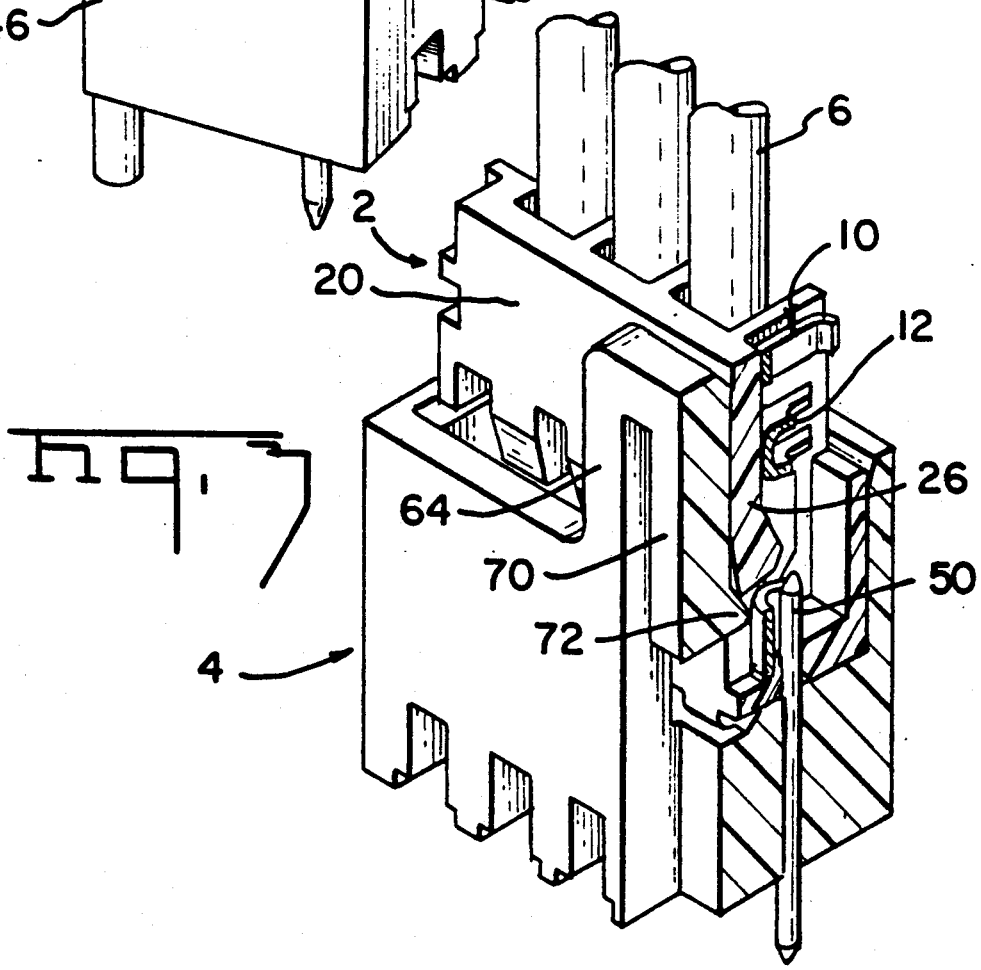
Figure 4:
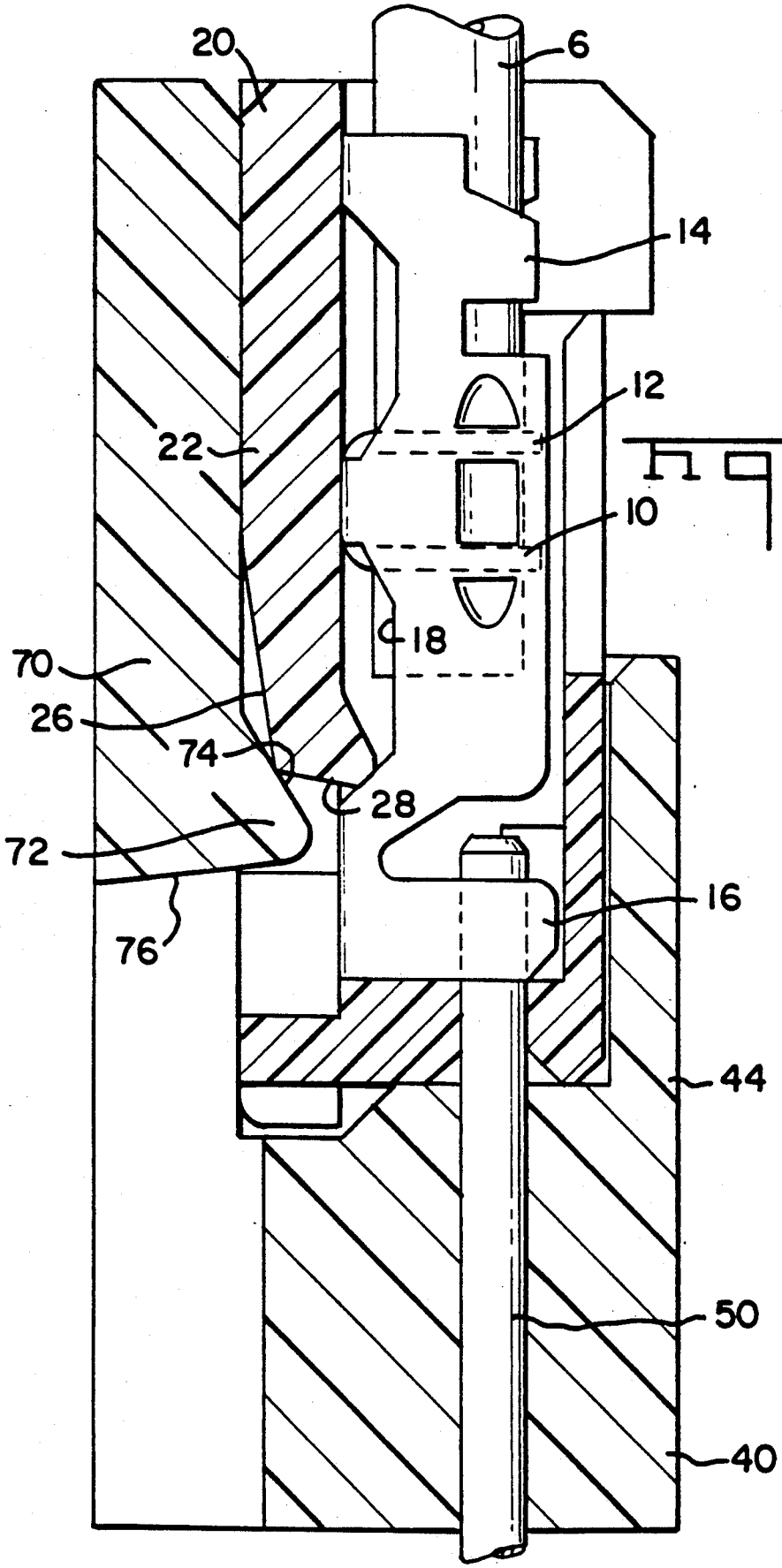
FIG. 4 is a section view showing a mated pin header and receptacle connector assembly.

The electrical connector assembly comprising the preferred embodiment of this invention comprises a receptacle connector 2 which is matable with an electrical connector header such as the shrouded header 4. A plurality of wires 6 are terminated at contact terminals 10 positioned within pockets in the receptacle connector 2. Each of the plurality of terminals 10 includes a slotted plate or insulation displacement contact section 12. A strain relief section 14 is located at one end of the contact terminal and the pin contact section 16 is located at the other end. The insulation displacement contact section 12 is formed by bending two plates upwardly from the base of the terminal leaving an opening 18. Further details of the individual contact terminals 10 are shown in U.S. patent application Ser. No. 07/280,753 filed Dec. 6, 1988, incorporated herein by reference.

The terminals 10 are held within a receptacle connector housing 20 formed of a conventional thermoplastic material. This housing 20 has one exterior surface 24, which comprises the back surface in the preferred embodiment of this invention. A plurality of plastic contact latches 22 are located along the back exterior surface 24. The outer surface 26 of the plastic contact latches 22 are inclined inwardly. These inwardly sloping surfaces 26 extend to the free ends 28 of the terminals. A laterally extending trough 30 is formed along the exterior surface 24 of the housing 20 adjacent the free ends 28 of the plastic contact latches 22. Individual terminals 10 are held in the receptacle connector 2 by the engagement of the free ends 28 of the plastic contact latches 22 in the opening 18 formed on terminals 10 as a result of bending the slotted plate upwardly from the base of the terminals 10.

The trough 30 formed on the exterior surface 24 of the receptacle connector housing 20 is generally continuous between opposite ends of the housing 20. The free ends 28 of the plastic latches 22 are defined one side of trough 30. Perpendicular shoulders 32 are formed on the housing 20 on the opposite side of the trough 20 from the free ends 28 of the plastic latches 22. Perpendicular shoulders are in the form of pedestals 32, a plurality of which are located along the length of the housing on the one exterior surface 24. Individual pedestals are joined by webs 36. A sharp edge 34 of the pedestals 32 is located at the intersection of each pedestal 32 with the trough 30.

The receptacle connector housing 20 also includes a pair of alignment ribs 38 located on opposite ends of the receptacle connector. One of these alignment ribs is shown in FIG. 1.

The shrouded electrical connector header 4 comprises integrally molded heading housing 40 have four walls 42, 44, 46 and 48. The four walls define a cavity 52 within which a receptacle connector 2 can be inserted. Header pins 50 project into the central cavity 52 from the floor of the shrouded header housing 40. The integrally molded header housing is formed of a conventional thermoplastic material, and the header pins 50 are also formed of conventional conductive material.

A connector latch 60 comprising a portion of the integrally molded header housing 40 extends upwardly from one of the sidewalls 42. This connector latch 60 includes a yoke section extending above the wall 42. The yoke section consists of two upwardly extending arms 62 and 64 which are joined at their upper ends by a crosspiece 66. A cantilever beam 70 forming part of the connector latch 60 extends downwardly from the yoke section. Cantilever beam 70 extends downwardly from the center of the crosspiece 66. In the preferred embodiment of this invention the cantilever beam 70 is thicker than the two arms 62, 64 which form a part of the yoke section. These two arms 62, 64 are therefore more flexible than the cantilever beam 70 and the combination of the upwardly extending arms 62, 64 and the cantilever beams 70 forms a double acting latch.

Cantilever beam 70 has a latching protrusion 72 located at the lower end of the cantilever beam. This latching protrusion 70 extends inwardly of the remainder of the cantilever beam 70 and is configured to engage and to secure the receptacle connector 2 when it is inserted into the cavity 52 formed in the shrouded header housing 40. Latch protrusion 70 includes an upper tapered surface, which is joined to a lower tapered surface 76.

The receptacle connector 2 and the pin header 4 are configured such that the receptacle connector 2 enters the cavity 52 formed by the four walls 42, 44, 46, 48 before the receptacle connector housing 20 engages the latching protrusion 72 formed on the cantilever beam 70. This permits smooth insertion of the receptacle connector into the connector header. The alignment ribs 38 on opposite ends of the receptacle connector housing 20, are received within alignment slots 54 and 56 located on the endwalls 46 and 48 of the inner housing. Receipt of the alignment ribs 38 within alignment slots 54 and 56 aligns the receptacle connector for smooth insertion into the pin header. The cantilever beam 70 extends downwardly from the crosspiece 66 by a distance sufficient for the latching protrusion 72 to be located below the top of the wall 42. This again ensures that the receptacle connector housing 20 will be received within the cavity 52 before engagement of the latching protrusion 42 on the exterior of the receptacle connector housing 20.

As the receptacle connector 2 is inserted into the pin header 4, the receptacle connector housing 20 will eventually abut the inwardly extending latching protrusion 72. As the lower edge of the receptacle housing 20 engages the upper tapered surface 74 of latching protrusion 72, continued force applied to the receptacle connector will cause the entire connector latch 60 to begin to deflect. In addition to the deflection of the cantilever beam 70, the two upwardly extending arms 62, 64 will also deflect. Thus, the connector latch 60 comprises a double acting latch. These upwardly extending and downwardly extending plastic portions of the connector latch 60 comprise deflectable resilient members suitable to permit sufficient deflection of the latching protrusion 72 to permit the receptacle connector to be fully inserted into the connector header.

Upon complete insertion of the receptacle connector to under the pin header 4, the latching protrusion 72 is received in the trough 30 and is configured to engage the perpendicular shoulders or sharp edges 34 of the pedestals 32. The lower tapered surface 76 which in the preferred embodiment is inclined at an angle of approximately 5° with respect to the horizontal, engages the sharp edge 34. The upper tapered surface 74 of the latching protrusion 72 is configured to fit along the inclined surface 26 of the plastic contact latches 22 since the connector latch 60 is located adjacent to and is positioned adjacent to the plastic contact latches when the receptacle connector is fully mated to the connector header. In this position the yoke section extends above the plastic contact latches 22. Engagement of the lower tapered surface 72 with the sharp edge 34 on pedestals 32 is sufficient to secure the receptacle connector 2 within the pin header 4 when subjected to forces normally encountered during operation. The receptacle connector 2 can, however, be removed from the pin header 4 by simply pulling upward on the receptacle connector to overcome the force necessary to cause the connector latch 60 to deflect outwardly as the sharp edge 34 rides upwardly along the tapered surface 76 of the latching protrusion 72. A sufficient force can be applied in this manner to permit toolless removal of the receptacle connector from the shrouded connector header 4.

In the event that an even more compliance spring is needed, the top of the housing wall 40 can be recessed to effectively increase the length of the arms 62, 64 thus increasing the compliance which can be achieved in connector latch 60. By using the double acting connector latch incorporated in the preferred embodiment of this invention, a low profile connector-header assembly is provided. It will be appreciated by those skilled in the art that the specific embodiment depicted herein is illustrative only and minor modifications, not outside the scope of the claims incorporated herein, would be apparent to one of ordinary skill in the art.

We claim:

1. An electrical connector assembly, comprising:

a receptacle comprising a housing and a plurality of terminals retained within said housing by contact latches, said latches having an inclined outer surface, said housing being provided with a trough extending laterally along an exterior surface adjacent free ends of said latches; and a header comprising a housing having a cavity for receiving said receptacle and pins extending into said cavity for electrically engaging said terminals, said housing further having a latch comprising a cantilever beam extending into said cavity from a crosspiece mounted on a pair of arms which are thinner than said beam and which extend outwardly from a wall, said beam having a protrusion thereon protruding into said cavity below a free surface of said wall and received in said trough in said receptacle.

2. The electrical connector assembly of claim 1 wherein said wall is open to receive said cantilever beam.

3. The electrical connector assembly of claim 1 wherein said header has two alignment slots on end walls of said housing and the receptacle includes an alignment rib received within each alignment slot.

4. The electrical connector assembly of claim 1 wherein the two arms are more flexible than the cantilever beam.

5. The electrical connector assembly of claim 1 wherein said receptacle housing has a sharp edge on one side of the trough with the protrusion being configured to secure the receptacle to the header by engagement with the sharp edge.

6. The electrical connector assembly of claim 5 wherein the receptacle has a plurality of pedestals formed on a side of the trough opposite from the contact latches with said sharp edge comprising an edge of one of the pedestals.

* * * * *